United States Patent [19]

Takenoya et al.

[11] Patent Number: 4,553,870

[45] Date of Patent: Nov. 19, 1985

[54] IMPACT TYPE COLOR PRINTER

[75] Inventors: Hideaki Takenoya, Hachioji; Fumiyuki Mishima, Hino, both of Japan

[73] Assignee: Janome Sewing Machine Industry Co. Ltd., Japan

[21] Appl. No.: 623,684

[22] Filed: Jun. 22, 1984

[30] Foreign Application Priority Data

Jun. 22, 1983 [JP] Japan ..... 58-110993

[51] Int. Cl.[4] ..... B41J 27/06; B41J 27/08

[52] U.S. Cl. ..... 400/662; 400/470; 400/554

[58] Field of Search ..... 400/124, 470, 471, 53, 400/662, 554, 555

[56] References Cited

U.S. PATENT DOCUMENTS 4,377,973 3/1983 Gantz et al. ..... 400/554 X 4,386,861 6/1983 Kurihara et al. ..... 400/554 X

FOREIGN PATENT DOCUMENTS 30872 3/1981 Japan ..... 400/554

*Primary Examiner*—Paul T. Sewell

*Attorney, Agent, or Firm*—William A. Drucker

[57] ABSTRACT

An impact type color printer is provided a control circuit which produces a random digit signal each time the printer is connected to a power supply, according to which random digit signal a platen is rotated so that one of plural impact sections axially arranged in each ink saturated member of different color is selected at random and positioned just opposite to a printing head to be subjected to impact thereby for printing operation.

4 Claims, 4 Drawing Figures

IMPACT TYPE COLOR PRINTER

BACKGROUND OF THE INVENTION

This invention relates to an impact type color printer.

As shown in FIG. 1, in a so-called impact type color printer, a platen 1 having a periphery provided with a plurality of members 2 saturated with different color inks and a printing head 3 having an impact means such as wires, are arranged opposite to each other with a printing paper 4 or any other material to be printed interposed therebetween, so that a selective one of the color inks is applied to the paper 4. The platen 1 is rotated by an electric motor (not shown) for color selection. The printing operation is carried out in such manner that the printing head 3 is moved one stroke together with the platen in parallel with a platen shaft 5 with a different speed, so that the printing head 3 may be progressively displaced with respect to the platen 1 in the axial direction thereof while the printing head 3 and the platen 1 are travelling along a line to be printed from one end to the opposite end of the line, so as to effectively and evenly utilize the axial printing range of an ink saturated member 2 of the platen 1. When the printing head 3 reaches the last end of the line, the printing paper 4 is transported in the direction of the arrow U to change the line, so that a new line may come to the position opposite to the head 3. However, if a relative position between the platen 1 and the printing head 3 is maintained always constant, the ink saturated member 2 will be partially consumed or worn out, and the print becomes inproper.

This may be avoided by rotating the platen 1 a little within the same member 2 with respect to the printing head 3 each time the line is changed, so that the same ink saturated member 2 will be subjected to impact by the printing head 3 in a different axial range thereof.

Nevertheless, there still remains another problem. More particularly, the partial ink consumption and abrasion of the ink saturated member 2 will also be caused if the initial angular position of the platen 1 is always predetermined with respect to the printing head 3 each time the printer is turned on for printing operation. Now, this problem remains to be solved.

SUMMARY OF THE INVENTION

Accordingly the present invention has been provided to eliminate the defects and disadvantages encountered in the printing operation performed by the prior art printer.

An object of the invention is to prevent ink saturated members of a platen from being partially or unevenly consumed and worn down, to thereby lengthen the life span of the ink saturated members of the platen.

According to the invention there is provided a color printer operated with supply of a power source to print a paper, which printer comprising a cylindrical platen provided on a periphery thereof with a plurality of members each saturated with a different color ink, each ink saturated member being divided into a number of printing areas each extending in an axial direction of the platen and arranged in an angular direction of the platen, the platen being rotatable around an axis thereof as well as movable in the axial direction; a printing head arranged opposite to the platen so as to cooperate with the platen to apply,an ink of a selected one of the ink saturated members to the paper located between the printing head and the platen, the printing head being movable together with the platen with respect to the paper from an initial printing position to a final printing position with a relative position therebetween being progressively changed, to thereby traverse an axial range of each ink saturated member until one cycle of printing operation is completed; means for rotating the platen with respect to the printing head; means for producing a random digit signal each time the printer is supplied with the power source; and control means operated in response to the random digit signal to control the platen drive means to determine the angular position of the platen at random with respect to the printing head so that any one of the printing areas is brought to a position opposite to the printing head.

BRIEF DESCRIPTION OF THE DRAWINGS

The foregoing and further objects and advantages of the invention can be fully understood from the following detailed description when read in conjunction with the accompanying drawings in which.

PREFERRED EMBODIMENT OF THE INVENTION

Figure 1:
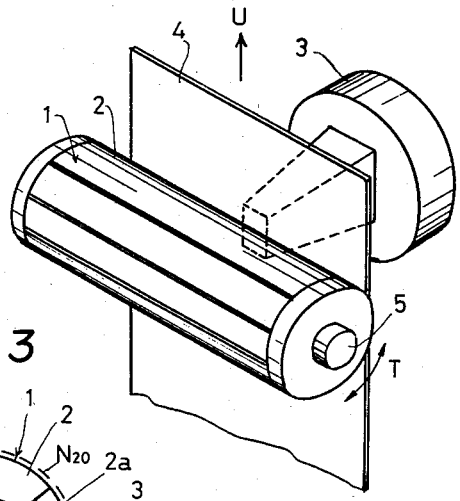
FIG. 1 is a perspective view diagrammatically partly showing a color printer to which the invention may be applied.

A preferred embodiment of the invention will now be described hereunder. Essential parts of a color printer used in the invention has been described in reference to FIG. 1 and accordingly the repeated description may be omitted.

Figure 2:
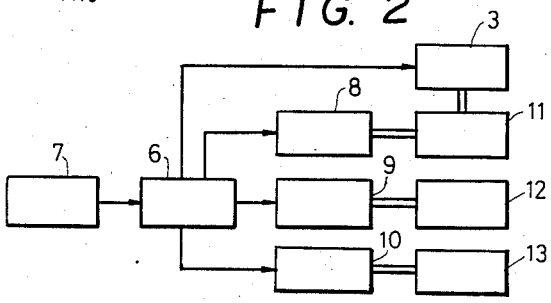
FIG. 2 is a block diagram of a control circuit according to the invention.

In FIG. 2, a control circuit 6 comprises a microcomputer which is operated in response to a print information issued from a personal computer 7 or the like medium, to control a solenoid (not shown) for driving impact wires of the printing head 3, and motors 8, 9 and 10, respectively. More particularly, the first motor 8 operates a printing head feeding mechanism 11 to thereby feed the printing head 3 in parallel with the platen shaft 5, from the initial impact position to the last impact position in a predetermined one direction, and then to return the printing head 3 to the initial impact position. The second motor 9 operates a color selection mechanism 12 to rotate the platen 1 in one of the directions as shown by the arrow (T) in FIG. 1, so that a selective one of the ink saturated members 2 having a specific color ink may be positioned opposite to the printing head 3. The third motor 10 operates a paper feed mechanism 13 to transport the paper 4 in the direction of the arrow (U) to renew a printing line.

Figure 3:
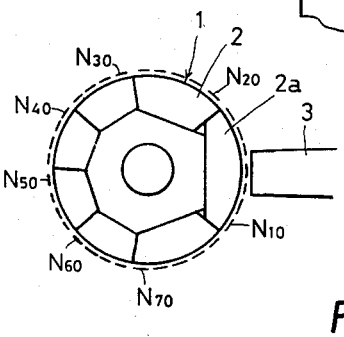
FIG. 3 is an explanatory side view showing a platen and a printing head of the color printer of the invention.

The periphery of the platen 1 is provided with plural members 2 each saturated with different color inks, but the surface area, namely the width of the members 2 in the rotating direction is preferably varied depending upon frequency of use of the color inks thereof. For example, a member 2*a* having a largest surface area, which is shown in FIG. 3 at a position opposite to the printing head 3, is saturated with a black color ink, that is a most frequently used color. Each member 2 has a number of predetermined impact areas arranged in the rotating direction thereof and each extending in the axial direction of the platen 1 and adapted to become subjected to impact effected by the printing head 3. The impact areas each located at one end of each member 2 are defined as ($N_{10}$) to ($N_{70}$) respectively, as shown.

The control circuit 6 will generate a random digit signal each time the printer is connected to a power supply (not shown) to start the control operation according to the invention, whereby one of the impact areas of a selected ink saturated member 2 is selected at random to be in an impact position confronting the printing head 3.

Figure 4:
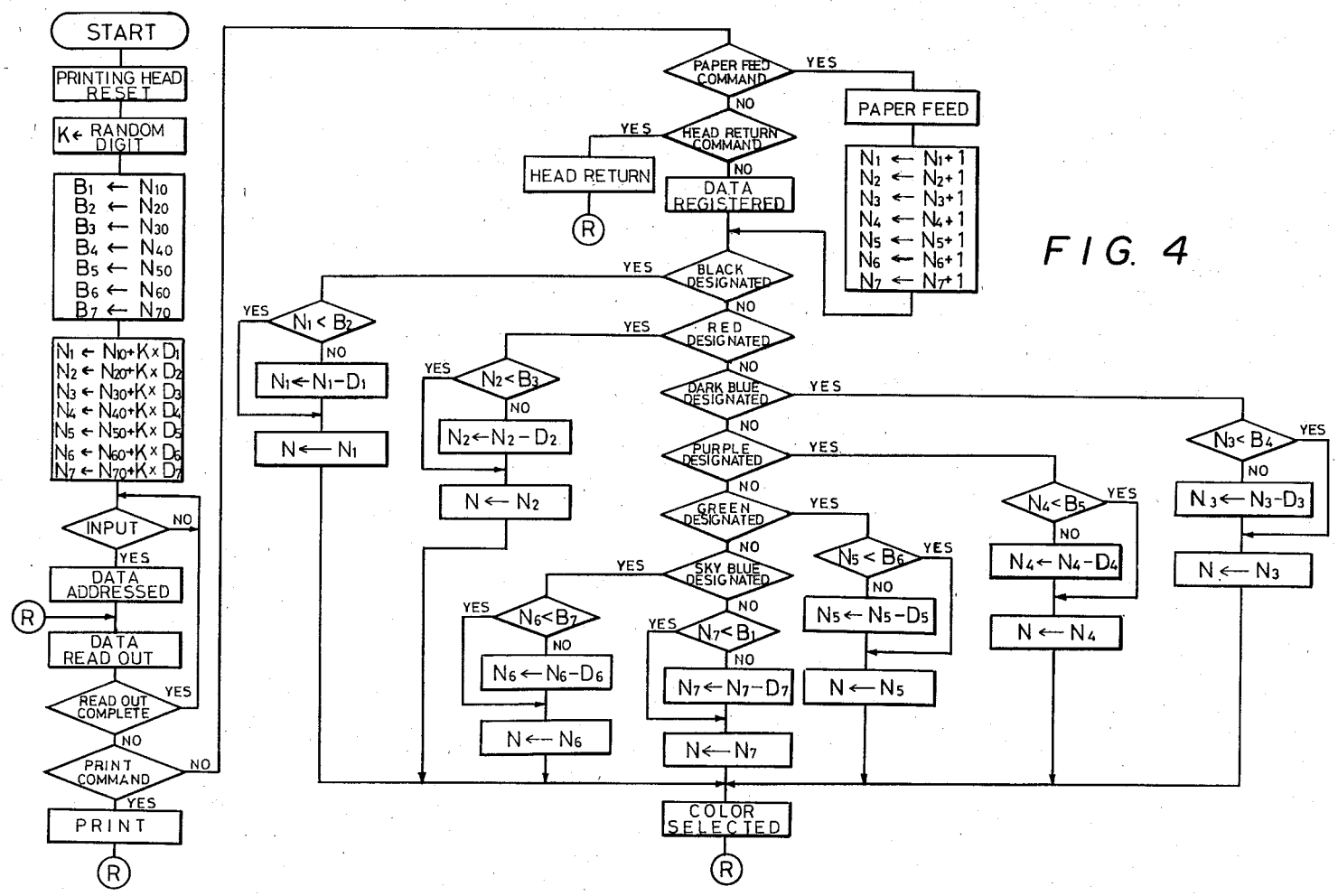
FIG. 4 is a flow chart of a control operation according to the invention.

The control operation according to the invention will be described while referring to FIG. 4 illustrating the flow chart.

When the printer is connected to the power supply for starting the control operation programmed by the control circuit 6, the printing head 3 is moved to the left (in FIG. 1) to take the predetermined initial impact position. Moreover, the control circuit 6 will concurrently produce a random digit (K) selected at random from 0.00–0.99, which is then registered therein.

The impact areas on the periphery of the platen 2 are respectively and successively numbered, the area ($N_{10}$) being defined to have its area number ($B_1$) of 1, and the area number increasing one by one in the counterclockwise direction. In the following description, the impact areas ($N_{10}$) to ($N_{70}$) are represented by area numbers ($B_1$) respectively. As described before, the number of the impact areas contained in the respective ink saturated members 2 may be varied, and the first member 2*a* has the number ($D_1$) of the impact areas including ($N_{10}$), the second to seventh members 2 on which the impact areas ($N_{20}$) to ($N_{70}$) are mounted respectively having the number of ($D_2$) to ($D_7$) of the impact areas. Thus, the total number (D) of the impact areas provided on the entire periphery of the platen 1 is expressed by $(D_1)+(D_2)+\cdots+(D_7)$, and the area numbers ($B_1$) to ($B_7$) of the impact areas ($N_{10}$) to ($N_{70}$) can be expressed by $(B_1)+(D_1)=(B_2)$, ---, $(B_6)+(D_6)=(B_7)$, $(B_7)+(D_7)=(B_1)+(D)$, respectively. In the embodiment shown in FIG. 3, ($D_1$) to ($D_7$) are 7, 5, 4, 4, 4, 4 and 5 respectively and ($B_1$) to ($B_7$) are 1, 8, 13, 17, 21, 25 and 29 respectively. Each member 2 including the impact area ($N_{10}$) to ($N_{70}$) is saturated with an ink of black, red, dark blue, purple, green, sky blue, yellow color respectively.

The above described area numbers ($B_1$) to ($B_7$) specific to the impact areas ($N_{10}$) to ($N_{70}$) are then also registered in the control circuit 6. Then, for the purpose of determining the initial relative position between the printing head 3 and the selected ink saturated member 2, the following calculations are made: $(N_1')=(B_1)+(K)\times(D_1)$, ---, $(N_7')=(B_7)+(K)\times(D_7)$; decimals of the respective values ($N_1'$) to ($N_7'$) obtained by the above calculations being omitted to obtain integers ($N_1$) to ($N_7$) which will be registered in the control circuit 6. For example, in the embodiment shown in FIG. 3, the value ($N_1$) will be varied from 1 to 7 depending upon the random digit (K) and, if the random digit (K) lies in a range from 0.15–0.28 then the value ($N_1$) will be 2.

Then, a series of command data are addressed to the control circuit 6 from the personal computer 7 and sequentially read out. When the read out data will not command to print, return the printing head to the initial impact position nor transmit the paper, but comprises the command to designate a color to be printed, then the color designating command will enter the color register section of the control circuit 6 in which various values (K), ($B_1$) to ($B_7$) and ($N_1$) to ($N_7$) have already been registered as above described.

Then, the comparison calculation is made between the value ($N_1$) to ($N_7$) corresponding to the section number ($B_1$) to ($B_7$) of the designated color and the next section number ($B_1$) to ($B_7$). More particularly, when a black color is designated, for example, then the value ($N_1$) is compared with the next section number ($B_2$). When the value ($N_1$) is smaller than the number ($B_2$), this value ($N_1$) will as it is become a command number (N), which is given to the motor 9 to rotate the platen 1 so that an impact area having the same section number with the command number (N) is positioned just opposite to the printing head 3. For example, if the random digit (K) is 0.15–0.28 resulting in the value ($N_1$) being 2, the second impact area (that is, an impact area arranged next the area ($N_{10}$) in the counterclockwise direction) in the black ink saturated member 2*a* will become ready to be subjected to impact by the printing head 3. After the above-described sequential operation have been completed, the step is back to a point (R) shown in FIG. 4. Then, in response to the next command for printing, a black color ink is printed on the paper 4.

After such a series of operation have been made to effect a print of the same (black) color in one continuous line on the paper 4, the printing head 3 is returned to the predetermined initial impact position by the motor 8 which is controlled by the head-return command.

Where it has been designated to print a red color ink in the next line, the value ($N_2$) will be 8, if the random digit (K) is 0.15, which is smaller than the next section number ($B_3$) of 13. Then, the impact area having the section number of 8, that is the impact area defined by ($N_{20}$), is selected, so that the platen 1 is rotated accordingly.

When the paper-feed command is read out to transport the paper, the registered values ($N_1$) to ($N_7$) will be automatically increased by one, and the comparative calculation is made between the increased value ($N_1$) to ($N_7$) and the next section number ($B_1$) to ($B_7$). In case the increased value ($N_1$)–($N_7$) coincides with the next section number ($B_1$)–($B_7$) which means that the impact area having the section number of ($N_1$)–($N_7$) does not exist in the ink saturated member of a designated color. For example, when the increased value ($N_1$) should possibly become 8 with respect to the designated black color, then the value ($N_1$) coincides with the value ($B_2$) and the impact area having the section number of 8 is the impact area defined by ($N_{20}$) which is saturated with a red color ink. In such case, the comparative calculation $(N_1)<(B_2)$ should be followed by a subtraction $(N_1)-(D_1)$ to obtain a subtracted value ($N_1$), assuring that the impact area specific to the section number of ($N_1$) remains in the black ink saturated member 2*a*.

In accordance with the invention, the initial angular position of each ink saturated member 2 is determined at random with respect to the printing head 3 each time the printer is turned on for printing operation. Thus, it is avoided that the ink of each ink saturated member is partially consumed, and simultaneously the ink saturated member is partially and unevenly worn out. This will contribute to uniformly applying an ink to the paper as well as to elongating a life span of the ink saturated member.

What is claimed is:

1. A color printer operated with supply of a power source to print a paper, comprising:

a cylindrical platen provided on the periphery thereof with a plurality of members each saturated with a different color ink, each ink saturated member being divided into a number of printing areas each extending in an axial direction of said member and arranged in an angular direction of said platen, said platen being rotatable around an axis thereof as well as movable in the axial direction;

a printing head arranged opposite to said platen so as to cooperate with said platen to apply an ink of a selected one of said ink saturated members to the paper located between said printing head and said platen, said printing head being movable together with said platen with respect to the paper from an initial printing position to a final printing position;

means for rotating said platen with respect to said printing head;

means for producing a random digit signal each time the printer is supplied with the power source; and control means operated in response to said random digit signal to control said platen drive means to determine the angular position of said platen at random with respect to said printing head to thereby set any one of said areas of a selected one of said ink saturated members to a position opposite to said printing head.

2. The printer according to claim 1 wherein said platen drive means is a reversible motor.

3. The printer according to claim 1 wherein the number of said ink saturated members is varied depending upon frequency of use of the printing colors.

4. The printer according to claim 1 further comprising means for producing a signal to feed said paper with respect to said platen and said printing head, wherein said control means is operated in response to said paper feeding signal to control said platen drive means to thereby progressively set the next printing area of said selected ink saturated member with respect to said printing head.

* * * * *